United States Patent [19]

Götzen

[11] 4,042,272

[45] Aug. 16, 1977

[54] HYDRAULIC GRAB

[76] Inventor: Heinrich Götzen, Bolberg 79, D 5802 Wetter 1, Germany

[21] Appl. No.: 586,659

[22] Filed: June 13, 1975

[30] Foreign Application Priority Data

June 14, 1974 Germany ..... 2428566

[51] Int. Cl.[2] ..... B66C 13/14

[52] U.S. Cl. ..... 294/88; 214/147 G; 294/106

[58] Field of Search ..... 294/88, 70, 71, 72, 294/69, 106, 118; 37/183 R, 184, 185, 186, 187, 188; 214/147 G

[56] References Cited

U.S. PATENT DOCUMENTS

| | | | |
|---|---|---|---|
| 3,294,435 | 12/1966 | Johnson et al. | 294/88 |
| 3,384,409 | 6/1968 | Guinot | 294/88 |
| 3,877,743 | 4/1975 | Johnson | 294/88 |
| 3,914,886 | 10/1975 | Berg et al. | 294/88 |

*Primary Examiner*—James B. Marbert

*Attorney, Agent, or Firm*—Schuyler, Birch, Swindler, McKie & Beckett

[57] ABSTRACT

The invention relates to an hydraulic octopus grab having a distributor head to which are pivoted in star formation grab blades and corresponding hydraulic operating cylinders. The distributor head is suspended at the bottom of a shaft which is positively rotatable by hydraulic means within a rotary head having a suspension eye mounted thereto at its upper end for suspending the grab.

12 Claims, 5 Drawing Figures

HYDRAULIC GRAB

The invention refers to an hydraulic octopus grab for excavators, cranes and other demolition, ditching, hoisting, grab and conveyor machines, having arranged underneath a suspension eye or other suspension means a distributor head in which are provided two feedways leading from external connectors, for connection to hydraulic flow and return lines, to ducts which supply hydraulic fluid to the operating cylinders of grab blades which are pivoted on the distributor head in star formation.

A known construction of hydraulic octopus grab has the advantage of compactness of the distributor head. The ducts are arranged in a star for connection to the operating cylinders, and radial webs, directly surrounding the distributor head and connected solidly to it, provide at their ends the connection hinges for the operating-cylinders and the blades. The ducts leading to the operating-cylinders are protected by the aforesaid arrangement, as are the operating cylinders themselves inside the blades. The distributor head moreover lies between two plates which on the one hand serve to stiffen the overall structure and also as additional protection of the hydraulic connections, especially against the material picked up by the blades. The suspension eye is attached directly onto the upper plate above the distributor head so that as mentioned above an extremely compact structure is formed of low structural height for the purpose of making full use of the space available for movement of the grab blades.

This known type of octopus grab cannot, however, fulfil a frequently stated requirement according to which the octopus grab is also to be rotatable, that is capable of performing a controlled rotary motion, preferably by an hydraulic drive.

There are indeed octopus grabs of another kind already known in a rotatable form but either the costs involved in the rotatable part are disproportionately high or else the construction has not proved satisfactory for various reasons. Thus, for example, by way of a mechanical-hydraulic solution the grab has been suspended from a spindle which engages via a coarse thread connection with a dog which in turn can be displaced longitudinally by a hydraulic drive in order in this way to set the spindle in rotation. Besides that the arrangement is also known of a central rotatable shaft provided with a toothed crown, the toothed crown engaging with a pair of hydraulically displaceable racks in order to set the central rotatable shaft in rotation. Instead of engagement with a pair or racks, single-acting hydraulically displaceable rotary drives by rack are also known. Finally commercial hydraulic motors also come into use as the drive for a rotatable arrangement of a distributor head as well as the blade mounting. The aforesaid solutions are either expensive to produce or are in service prone to give trouble and/or exhibit a relatively short working life.

There exists, therefore, the problem of making the hydraulic octopus-grab mentioned above rotatable in a simple compact construction and providing it with an appropriate rotary drive.

In accordance with the invention, an hydraulic octopus grab has means by which the grab may be suspended fixed to the top of a rotary head in which a vertical shaft is mounted and is hydraulically rotatable, the shaft carrying at its lower end a distributor head to which are pivoted in star formation grab blades and corresponding hydraulic operating cylinders and which incorporates ducts for supplying hydraulic fluid to the cylinders and leading to external connectors for connecting the ducts with hydraulic fluid flow and return lines.

With this construction, the distributor head is attached to a shaft extending vertically upwards which in turn is arranged in a rotary head to which the suspension eye or other suspension means is attached. The suspension eye it rotatable with respect to the distributor head and the mountings for the grab blades connected with it. The rotary motion of the vertical shaft is effected by an hydraulic drive or else an hydraulic control, and thus by means of the same medium as is already being used for actuation of the operating cylinders. This arrangement enables a compact construction to be preserved, since the height of the construction is increased merely by the height of the distributor head which with an appropriate design can be kept low. The hydraulic rotary drive can readily be provided by means of a conventional hydraulic motor or one of the other kinds of drive mentioned above. However, for the hydraulic rotary drive of the shaft there are preferably provided in the rotary head, between a wall of its housing and the shaft, pressure chambers to which hydraulic pressure can be applied through connectors in a housing wall of the rotary head, each chamber being at least partly defined by relatively movable parts fixed to the housing and shaft whereby the shaft may be rotated in the housing in one sense or the other by application of hydraulic pressure to an appropriate chamber or chambers. The relatively movable parts may be, for example, projections or lobes. In this case advantage is taken of the fact that, for the mechanical connection between the suspension eye and the mountings and blades part of the grab, a rotary head with a strong housing wall is necessary anyhow, inside which pressure chambers can be created at the periphery of the shaft, by means of which depending upon the feed of pressure medium to a certain pressure chamber the shaft can be turned at option in one sense or the other. This rotary drive can be executed structurally with ease and requires little room. It has moreover the advantage that the pressure hoses lead to connections fixed in the housing and do not rotate which from experience is found to produce considerable wear.

Preferably, two pressure chambers are formed by dividing an annular chamber formed between the housing wall and the shaft by means of two segments, one fixed to the shaft and one fixed to the housing wall, feed bores for supplying hydraulic pressure to the pressure chambers opening through the housing wall adjacent to the segment fixed to the housing wall. This construction allows rotation of the shaft and the blades nearly up 360° depending upon the angles taken up by the two segments. If the shaft pivots in one direction into the extreme position of rotation, one of the chambers decreases down to a small residual volume, whilst the volume of the other chamber increases accordingly. The proportions reverse as soon as the shaft is swung round into the other extreme position of rotation.

The shaft and the inner wall of the housing are preferably associated with one another in cross-section in the form of concentric circles. This is the simplest arrangement for manufacture and assembly, and moreover calls for little space.

It is likewise advantageous for manufacture and assembly if the segment fixed to the housing is bolted firmly to the inside of the wall of the housing by bolts introduced from outside through the wall of the housing of the rotary head and let in flush with it. For the same purpose, the segment on the shaft may have bores passing through it in the radial direction for receiving fixing-screws which engage tapped holes set radially in the shaft. The screws employed are preferably shorted than the through-bores. By this means it is possible to attached the shaft-attached segment to the shaft even after mounting the shaft in the rotary head, because the segment with the screws already mounted in it is introduced axially into the annular chamber and the screws are then screwed home into the shaft through boltholes or bores existing in the wall of the housing. After that the shaft with the segment bolted to it is swung round in order to attach the segment which is fixed to the housing, by bolts inserted from outside through the wall of the housing of the rotary head.

The ducts may be connected to two feedways in the distributor head for feeding the pressure medium to the operating-cylinders may as hitherto have connectors mounted in a top plate of the distributor head, that is, in a position next to the rotary head. This solution has however the disadvantage that the hoses turn with it when the shaft is turned, and this leads to corresponding wear with the danger of damage to the hoses. It is instead preferred if the ducts are connected to two feedways in the distributor head, the two feedways continuing through the shaft and being connected, in any position of rotation of the shaft, with the external connectors which are mounted in a non-rotatable part of the rotary head. In this way a considerably more secure feed of the pressure medium is achieved. The shaft in which the feedways from the distributor head continue have at their upper ends or at the surface inlets, which, by appropriate measures are kept continually connected with external connectors for the feed of the pressure medium. This provides the possibility of making the external connectors for the pressure hoses fixed on the housing of the rotary head.

Preferably the two inlets open into feed chambers arranged in the vicinity of the shaft and which connect with the inlets in any position of rotation of the shaft. The feed chambers may be arranged at the top end of the shaft but advantageously surround the shaft at its surface. Each feed chamber is associated with a certain inlet on the shaft, which in any position of rotation of the shaft can be acted upon by pressure-oil which then is led from the inlet in question via the feedways in the shaft itself as well as in the distributor head, to the appropriate operating-cylinder.

Preferably, the feedways run in the axial direction of the shaft and are connected to respective crossbores at different axial positions, the crossbores opening into respective feed chambers formed as annular rings surrounding the surface of the shaft. The two main feedways which the individual ducts in the distributor head leave in star formation consequently extend through the distributor head into the shaft in which at different heights crossbores leave the feedways and open at the surface of the shaft into inlets which in turn are then surrounded each by a feed chamber with which they connect in any position of rotation of the shaft. The feed chambers are fed with pressure medium via stationary connectors in the wall of the housing.

The feed chambers are preferably formed in the shape of annular grooves in an annular chamber-plate which is fixed inside the wall of the housing of the rotary head with a seal between them.

On the other hand the pressure chambers are formed between the upper face of the chamber-plate and the underside of an intermediate plate supporting the rotary bearing for the shaft.

The rotary bearing is advantageously arranged between a nut which can be screwed onto the top end of the shaft and the intermediate plate. It is further advantageous if the suspension eye is attached to a cover plate to the rotary head, which together with the intermediate plate is bolted firmly to the wall of the housing means of a ring of vertical anchor-bolts. All of the seals can be effected in a simple manner by O-rings.

The above-mentioned measures result in a particularly strong reliable structure which is relatively simple to assemble and where necessary also to dismantle.

One example of a grab construction in accordance with the invention is illustrated in the accompanying drawings in which.

Figure 1:
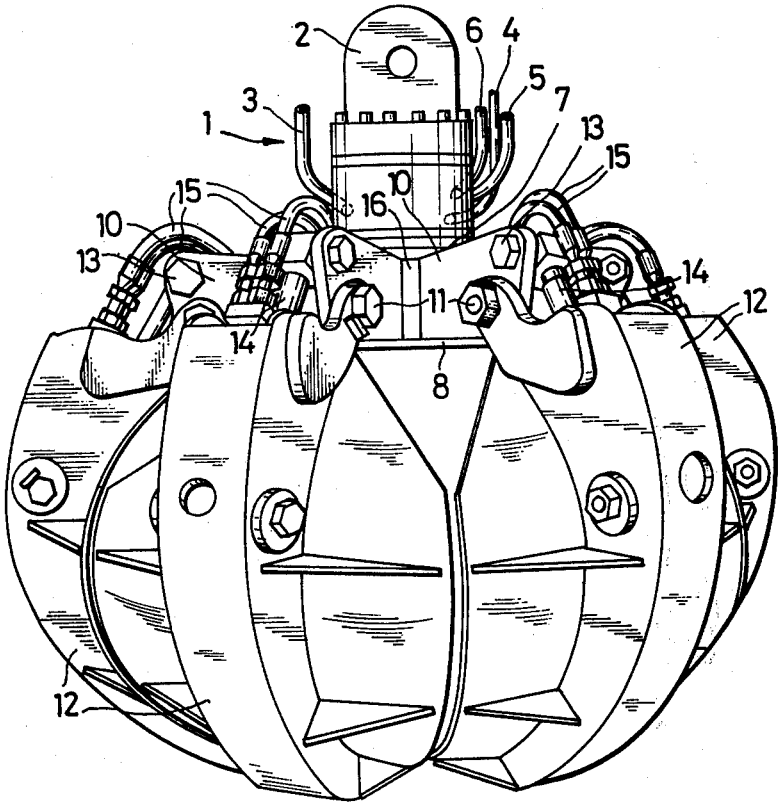
FIG. 1 is a side elevation.

The octopus-grab illustrated in FIG. 1 has at the top a rotary head 1 with a suspension eye 2 attached to the top of it, and also having pairs of pressure hoses 3, 4 and 5, 6 for the feed of hydraulic pressure fluid, as is explained later in detail. Underneath the rotary head 1 is fitted rotatably a distributor head 16 comprising two plates 7, 8 between which are fixed webs 10 arranged in a star. At the outer ends of the webs are supported pivotally on the one hand blades 12 by means of hinges 11 and on the other hand operating-cylinders 14 for the blades by means of hinges 13. Connecting hoses 15 feed the pressure medium from the distributor head 16 to the double-acting operating-cylinders 14.

Figure 2:
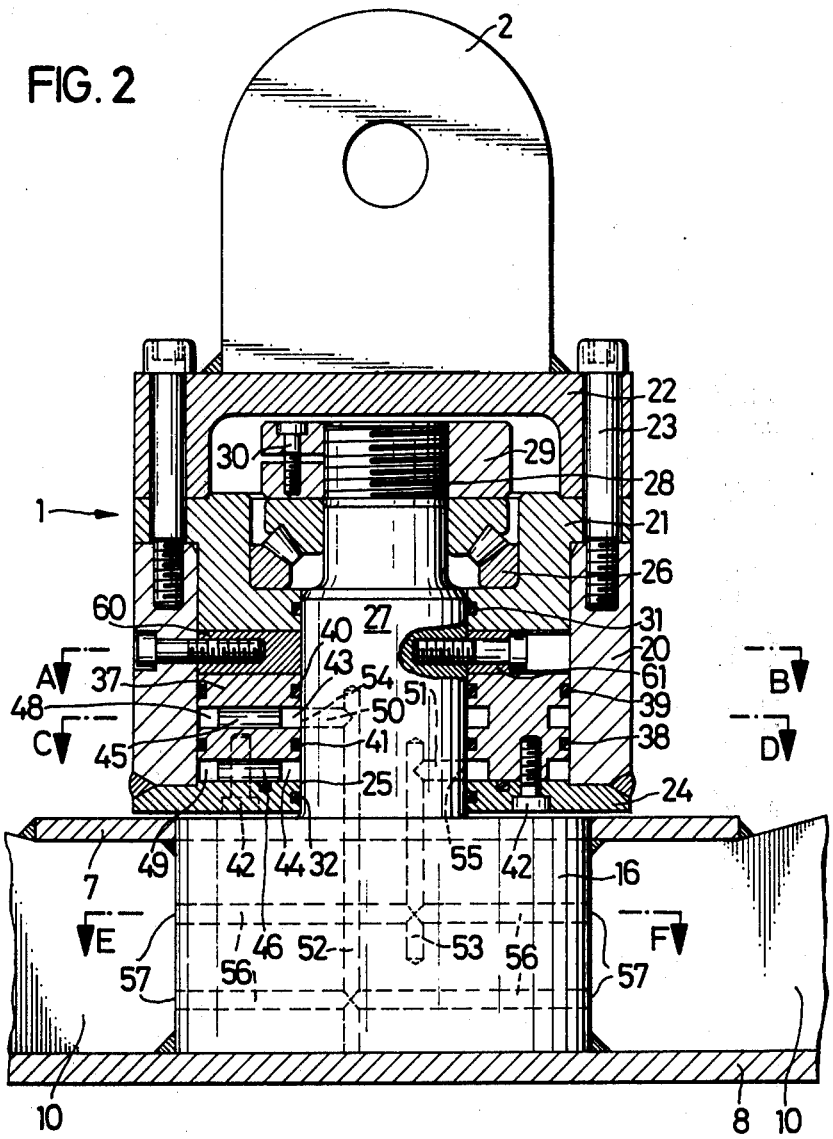
FIG. 2 is a vertical section through the top part of the grab.

The rotary head 1 shown in FIG. 2 to an enlarged scale has an overall cylindrical shape with a housing wall 20 to the top face of which are attached by means of a ring of anchor-bolts 23 an intermediate plate 21 and on top of that a coverplate 22. The suspension eye 2 is welded onto the coverplate 22. Onto the underside of the wall 20 of the housing is attached, preferably welded, a bottom plate 24 with a central bore 25.

The rotary head 1 carries in a manner obvious from the drawings a vertical shaft 27 which is supported by a nut 29 screwed onto its threaded end 28 and provided with a locking-pin 30, on a radially and axially loadable rotary bearing 26 which in the present case is formed as tapered-roller bearing and is fixed in a recess in the intermediate plate 21 by its outer ring. O-rings 31, 32 seal the shaft 27 underneath the bearing to the intermediate plate 21 and to the bottom plate 24 respectively.

The arrangement described above creates a rotatable bearing for the shaft 27 in combination with a high load capacity above all in the axial direction. This is necessary since as shown in FIG. 2 the shaft 27 continues via the plate 7 into the distributor head 16 or is attached to it, as preferred, so that the rotatable shaft 27 carries the whole of the bottom assembly of the grab inclusive of the blades 12 and their mountings in a rotatable arrangement.

Figure 4:
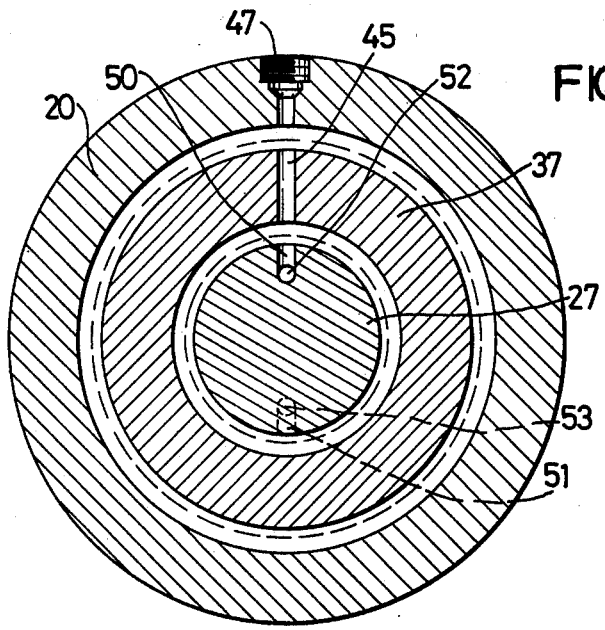
FIG. 4 is a section taken on the line C – D in FIG. 2.

Inside the wall 20 of the housing an annular chamber plate 37 is inserted and sealed above and below externally by means of O-rings 38, 39 and 40, 41 next to the shaft, and fixed and fastened by means of bolts 42 in its angular position. The exact structural form and its advantages appear from FIG. 2 in combination with the sectional view as FIG. 4. It can be seen that between the shaft 27 and annular chamber plate 37 a plurality of grooves are spaced one above the other, an annular upper feed-chamber 43 and a likewise annular lower feed-chamber 44 being formed. These connect respectively via crossbores 45, 46 with connectors 47 not shown in FIG. 2 (cf. FIG. 4) to which the pressure hoses feeding in the pressure medium are connectable in the usual way. Advantageously outer grooves 48, 49 are further provided in the chamber plate 37, which also serve as storage chambers for the receipt of pressure medium and primarily fulfil the purpose that when the chamber plate 37 is being fitted the crossbores 45, 46 do not have to be brought with extreme accuracy into alignment with the corresponding bores in the connectors 47.

Figure 5:
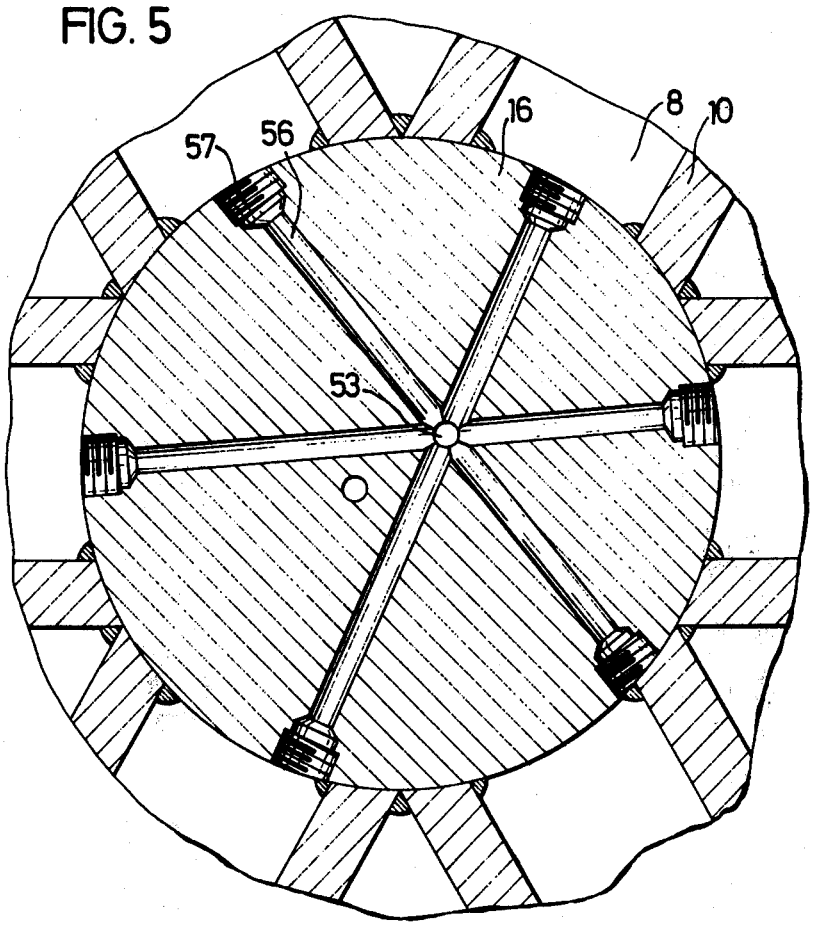
FIG. 5 is a section taken on the line E – F in FIG. 2.

At the same height as each of the two feed chambers 43, 44 lying one above the other lies an inlet 54 and 55 respectively in the surface of the shaft 27, and the inlets 54, 55 continue into crossbores 50, 51 in the shaft 27, which open into vertical feedways 52, 53 which extend in the longitudinal direction first of all through the shaft 27 and thence into the distributor head 16. At this point branching of the feedway takes place into feed bores 56 (cf. FIG. 5) arranged in the form of a star, with outlets 57 for connection of the connector hoses leading to the operating-cylinders 14.

Figure 3:
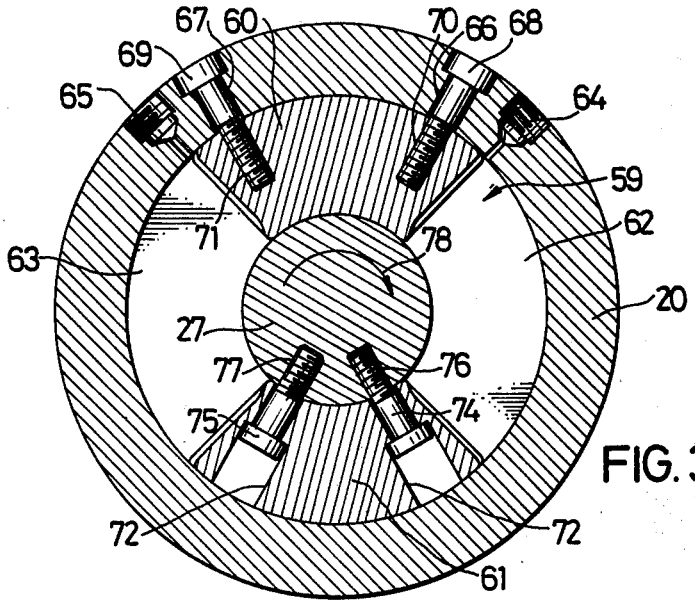
FIG. 3 is a section taken on the line A – B in FIG. 2.

With the arrangement described above, a permanent connection is guaranteed from the pressure hoses 3, 4 (cf. FIG. 1) via the connectors 47, the outer grooves or chambers 48, 49, the crossbores 45, 46, the inlets 54, 55, the crossbores 50, 51, the feedways 52, 53 and the feed bores 56 via the outlets 57, the connector hoses 15 to the operating-cylinders 14. Above all the inlets 54, 55, independent of the position of rotation of the shaft 27 at any moment with respect to the chamber plate, are continually in connection with the feed bores 43, 44 without the hoses feeding in the pressure medium being subjected to any movement whatever and wear occasioned by it, if the shaft 27 and the part of the grab connected to it perform rotary motions. Between the chamber plate 37 and the intermediate plate 21 lies an annular chamber 59 which is bounded at the sides on the one by the shaft 27 and on the other by the inner face of the wall 20 of the housing. This annular chamber 59 is split up by the segments which can be seen particularly in FIG. 3 but also in FIG. 2 and consist of a segment 60 fixed to the housing and a segment 61 fixed to the shaft, into two pressure chambers 62, 63. Each of the pressure chambers 62, 63 has directly adjacent to the segment 60 a connector 64 and 65 respectively for connection of the pressure hoses 5, 6 (cf FIG. 1). The segment 60 has tapped holes 70, 71 of the kind illustrated, into which bolts 68, 69 are screwed from the outside to seat in bores 66, 67 in the wall 20 of the housing for fixing the segment. The segment 61 is attached to the shaft by means of bolts 74, 75 in the manner seen in FIG. 3, in which bolts 74, 75 seating in bores 72, 73 exhibiting shoulders, are screwed home into tapped holes 76, 77 in the shaft 27.

With the arrangement described above a rotary drive for the shaft 27 is created, in that, for example, for a rotation of the shaft 27 to the right (with reference to FIG. 3) as indicated by the arrow 78, the chamber 62 is acted upon by pressure medium via the connector 64 so that because of the higher pressure in the pressure chamber 62 and the lower pressure in the pressure chamber 63 the segment 61 next the shaft gets displaced in the direction of the arrow 78 and thereby the whole grab underneath the rotary head 1 performs a corresponding twist.

I claim:

1. An hydraulic octopus grab comprising a rotary head, means fixed to the top of said rotary head for suspending said grab, a vertical shaft rotatably mounted within said rotary head, pressure chambers formed within said rotary head and adapted to be supplied with hydraulic pressure through connectors in a housing wall of said rotary head, each chamber being at least partly defined by relatively movable parts fixed to said housing wall and said shaft respectively whereby said shaft may be rotated in said housing in one direction or the other by application of hydraulic pressure to appropriate ones of said chambers, a distributor head carried at the lower end of said shaft and rotatable therewith, grab blades and corresponding hydraulic operating cylinders pivotally mounted on said distributor head, and said distributor head incorporating ducts for supplying hydraulic fluid to said cylinders and leading to external connectors for connecting said ducts with hydraulic fluid flow and return lines.

2. A grab according to claim 1, wherein an annular chamber is formed between said housing wall and said shaft and said two pressure chambers are formed between two segments located in said annular chamber, a first one of said segments being fixed to said shaft and a second one of said segments being fixed to said housing wall, and feed bores opening through said housing wall adjacent to said second segment for selectively supplying hydraulic pressure to said chambers.

3. A grab according to claim 2, wherein said second segment is bolted to an inner surface of said housing wall by bolts passing through said wall and let into an outer surface of said wall so as to be substantially flush therewith.

4. A grab according to claim 2, wherein said first segment is bolted to said shaft by screws extending through radial bores in said first segment and engaging tapped holes in said shaft.

5. A grab according to claim 4, wherein said screws are shorter than said radial bores.

6. An hydraulic octopus grab comprising a rotary head, means fixed to the top of said rotary head for suspending said grab, a vertical shaft rotatably mounted within said rotary head, hydraulic means adapted to positively rotate said shaft in one direction or the other within said rotary head, a distributor head carried at the lower end of said shaft and rotatable therewith, grab blades and corresponding hydraulic operating cylinders pivotally mounted on said distributor head, said distributor head incorporating ducts for supplying hydraulic fluid to said cylinders, said ducts being connected to two feed ways in said distributor head, said two feed ways continuing through said shaft, said feed ways in said shaft opening into feed chambers formed between said shaft and a nonrotatable part of said rotary head, said nonrotatable part of said rotary head having crossbores for connecting said feed chambers in any position of rotation of said shaft to external connectors provided in said rotary head, pressure storage chambers further provided in said nonrotatable part between said crossbores and external connectors, and said external connectors being secured to hydraulic fluid flow and return lines for operating said cylinders through said ducts.

7. A grab according to claim 6, wherein said feed ways run in the axial direction of said shaft and are connected to respective cross bores in said shaft at different axial positions, said cross bores opening into respective feed chambers formed as annular rings surrounding said shaft.

8. A grab according to claim 7, wherein said ring-shaped feed chambers are formed by annular grooves in said nonrotatable part of said rotary head, said nonrotatable part comprising an annular chamber plate fixed within a housing wall of said rotary head and sealed to said wall and shaft.

9. A grab according to claim 6, wherein said pressure storage chambers comprise annular grooves.

10. An hydraulic octopus grab comprising a rotary head, means fixed to the top of said rotary head for suspending said grab, a vertical shaft rotatably mounted within said rotary head, a distributor head carried at the lower end of said shaft and rotatable therewith, grab blades and corresponding hydraulic operating cylinders pivotally mounted on said distributor head, said distributor head incorporating ducts for supplying hydraulic fluid to said cylinders and leading to external connectors for connecting said ducts with hydraulic fluid flow and return lines, said ducts being connected to two feed ways in said distributor head, said two feed ways continuing through said shaft and being connected, in any position of rotation of said shaft, with said external connectors, said external connectors being mounted in a nonrotatable part of said rotary head, said two feed ways running in the axial direction of said shaft and being connected to respective crossbores at different axial positions, said crossbores opening into respective feed chambers formed in a nonrotatable part of said rotary head as annular rings surrounding said shaft, said ring shaped feed chambers being formed by annular grooves in an annular chamber plate fixed within a housing wall of said rotary head and sealed to said wall and shaft, and an annular chamber formed within a housing wall of said rotary head around said shaft and between an upper face of said chamber plate and the underside of an intermediate plate supporting a rotary bearing for said shaft, said annular chamber being divided by two segments into two pressure chambers, a first one of said segments being fixed to said shaft and a second one of said segments being fixed to said housing wall, and feed bores opening through said housing wall adjacent to said second segment for selectively supplying hydraulic pressure to said pressure chambers whereby said shaft may be rotated in said housing in one direction or the other by application of hydraulic pressure to appropriate ones of said chambers.

11. An hydraulic octopus grab comprising a rotary head means fixed to the top of said rotary head for suspending said grab, a vertical shaft rotatably mounted within said rotary head, a rotary bearing for said shaft mounted between a nut screwed onto a screw threaded upper end of said shaft and an intermediate plate fixed within said rotary head, hydraulic means adapted to positively rotate said shaft in one direction or the other within said head, a distributor head carried at the lower end of said shaft and rotatable therewith, grab blades and corresponding hydraulic operating cylinders pivotally mounted on said distributor head and said distributor head incorporating ducts for supplying hydraulic fluid to said cylinders and leading to external connectors for connecting said ducts with hydraulic fluid flow and return lines.

12. A grab according to claim 11, wherein said suspension means for suspending said grab is a eye attached to a cover plate, said cover plate together with said intermediate plate being bolted to an upper end of a cylindrical housing wall of said rotary head by means of ring of vertical bolts.

* * * * *